US011011817B2

(12) United States Patent
Zheng et al.

(10) Patent No.: US 11,011,817 B2
(45) Date of Patent: May 18, 2021

(54) WAVEGUIDE-EXCITED TERAHERTZ MICROSTRIP ANTENNA

(71) Applicant: Tsinghua University, Beijing (CN)

(72) Inventors: Xiao-Ping Zheng, Beijing (CN); Xia-Hui Han, Beijing (CN); Sheng-Chuang Bai, Beijing (CN); Hua Geng, Beijing (CN); De-Jian Zhang, Beijing (CN); Jia-Ming Liu, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 0 days.

(21) Appl. No.: 16/703,864

(22) Filed: Dec. 5, 2019

(65) Prior Publication Data

US 2020/0185805 A1 Jun. 11, 2020

(30) Foreign Application Priority Data

Dec. 10, 2018 (CN) ..... 201811505213.4

(51) Int. Cl.

| | |
|---|---|
| ***H01P 5/08*** | (2006.01) |
| ***H01P 5/107*** | (2006.01) |
| ***H01Q 13/28*** | (2006.01) |
| ***H01Q 13/26*** | (2006.01) |

(52) U.S. Cl.

CPC ..... *H01P 5/082* (2013.01); *H01P 5/107* (2013.01); *H01Q 13/26* (2013.01); *H01Q 13/28* (2013.01)

(58) Field of Classification Search

CPC ..... H01P 5/082; H01P 5/107; H01Q 13/28; H01Q 13/26

USPC ..... 333/248

See application file for complete search history.

(56) References Cited

U.S. PATENT DOCUMENTS

2020/0335873 A1* 10/2020 Achour ..... H01Q 13/08

FOREIGN PATENT DOCUMENTS

CN 109216904 B * 2/2020
CN 211700561 U * 10/2020

* cited by examiner

*Primary Examiner* — Robert J Pascal
*Assistant Examiner* — Kimberly E Glenn

(57) ABSTRACT

The present disclosure provides a waveguide-excited terahertz microstrip antenna. The antenna includes a dielectric substrate, a ground plate, a rectangular waveguide, a metal pin, and a radiation patch. The dielectric substrate has a first surface and a second surface opposite to the first surface. The ground plate is located on the first surface of the dielectric substrate and defines a coupling slit. The rectangular waveguide is located on a surface of the ground plate away from the dielectric substrate and extended substantially along a first direction parallel to the first surface. The metal pin is located inside the rectangular waveguide, and is in contact with the ground plate and substantially perpendicular to the ground plate. The radiation patch is located on the second surface of the dielectric substrate.

17 Claims, 6 Drawing Sheets

WAVEGUIDE-EXCITED TERAHERTZ MICROSTRIP ANTENNA

CROSS-REFERENCE TO RELATED APPLICATIONS

This application claims all benefits accruing under 35 U.S.C. § 119 from China Patent Application No. 201811505213.4, filed on Dec. 10, 2018 in the China National Intellectual Property Administration, the content of which is hereby incorporated by reference.

FIELD

The present disclosure relates to the field of terahertz technology, and particularly to waveguide-excited terahertz microstrip antennas.

BACKGROUND

The terahertz wave has been applied more and more with the development of the terahertz technology. A terahertz transmitting antenna, which converts a guided terahertz wave emitted from a terahertz source into a terahertz wave capable of propagating in free space to achieve detection in specific region, is an important device in the terahertz technology. Since a current terahertz source generally has a low power, a high performance terahertz transmitting antenna is required to increase an effective detection distance of the terahertz wave.

The terahertz wave is a high-frequency wave with a short wavelength, which makes a horn antenna difficult to be manufactured for transmitting the terahertz wave. Besides, a microstrip antenna excited by a coaxial cable is unable to transmit a high frequency electromagnetic wave over 50 GHz and thus is not suitable for transmitting the terahertz wave. A microstrip antenna excited by a microstrip for transmitting the terahertz wave has disadvantages of high return loss, narrow bandwidth, and low gain.

SUMMARY

The present disclosure provides a waveguide-excited terahertz microstrip antenna.

The waveguide-excited terahertz microstrip antenna includes a dielectric substrate, a ground plate, a rectangular waveguide, a metal pin, and a radiation patch. The dielectric substrate has a first surface and a second surface opposite to the first surface. The ground plate is located on the first surface of the dielectric substrate and defines a coupling slit. The rectangular waveguide is located on a surface of the ground plate away from the dielectric substrate and extended substantially along a first direction. The metal pin is located inside the rectangular waveguide and is in contact with the ground plate and substantially perpendicular to the ground plate. The radiation patch is located on the second surface of the dielectric substrate.

In an embodiment, the rectangular waveguide is attached on the surface of the ground plate away from the dielectric substrate. The ground plate is sandwiched between the rectangular waveguide and the dielectric substrate.

In an embodiment, the radiation patch is attached on the second surface. The radiation patch has a rectangular shape with the first direction as its length direction and with a second direction substantially perpendicular to the first direction and substantially parallel to the first surface of the dielectric substrate as its width direction.

In an embodiment, a width of the radiation patch satisfies the following equation I:

$$W_p = \frac{c}{2f_0}\left(\frac{\varepsilon_r + 1}{2}\right)^{-\frac{1}{2}}; \quad \text{I}$$

and a length of the radiation patch satisfies the following equation II:

$$L_p = \frac{c}{2f_0}\frac{1}{\varepsilon_{re}} - 2\Delta L; \quad \text{II}$$

wherein c represents a light speed, $f_0$ represents a central working frequency of terahertz microstrip antenna, $\varepsilon_r$ represents a relative permittivity of the dielectric substrate, $\varepsilon_{re}$ represents an effective relative permittivity of the dielectric substrate, and $\Delta L$ represents an increase in effective length caused by a fringing field of the terahertz microstrip antenna.

In an embodiment, the coupling slit is a through-slot extending through the ground plate substantially along a third direction perpendicular to the first surface of the dielectric substrate and lengthening substantially along the second direction perpendicular to the first direction and the third direction.

In an embodiment, a length of the coupling slit is about 30% to about 80% of a center working wavelength of the terahertz microstrip antenna, and a width of the coupling slit is about 1% to about 6% of the center working wavelength of the terahertz microstrip antenna.

In an embodiment, the metal pin extends through the rectangular waveguide substantially along the third direction perpendicular to the first surface of the dielectric substrate. A location and/or a diameter of the metal pin is capable of minimizing a return loss of the terahertz microstrip antenna at the center working frequency of the terahertz microstrip antenna.

In an embodiment, the diameter of the metal pin is about 2% to about 6% of a center working wavelength of the terahertz microstrip antenna.

In an embodiment, a distance between an axis of the metal pin substantially along the third direction and a first center line of the rectangular waveguide substantially along the first direction is about 10% to 30% of the center working wavelength of the terahertz microstrip antenna. A distance between the axis of the metal pin substantially along the third direction and the center line of the coupling slit substantially along the second direction is about 10% to about 40% of the center working wavelength of the terahertz microstrip antenna.

In the present disclosure, the coupling slit and the impedance matching metal pin of the terahertz microstrip antenna increase the coupling efficiency of the waveguide with the radiation patch and enable the input impedance of the terahertz microstrip antenna to be adjustable. As such, the terahertz microstrip antenna of present disclosure can have a low return loss, a narrow bandwidth, and a low gain within the terahertz waveband.

BRIEF DESCRIPTION OF THE DRAWINGS

Implementations are described by way of example only with reference to the attached drawings. The drawings are not necessarily to scale, and the proportions of certain parts may be exaggerated to better illustrate details and features.

DETAILED DESCRIPTION

For a clear understanding of the technical features, objects and effects of the present disclosure, specific embodiments of the present disclosure will now be described in detail with reference to the accompanying drawings. It is to be understood that the following description is merely exemplary embodiments of the present disclosure, and is not intended to limit the scope of the present disclosure.

It should be noted that the relational terms such as "first" and "second" are used to differentiate an entity or operation from another entity or operation, and do not require or imply any actual relationship or sequence between these entities or operations. It should be noted that references to "an," "another," or "one" embodiment in the present disclosure are not necessarily to the same embodiment, and such references mean "at least one."

Figure 1:
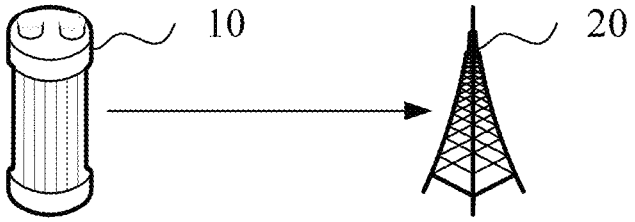
FIG. 1 shows an application environment of a waveguide-excited terahertz microstrip antenna according to an embodiment of the present disclosure.

The present disclosure provides a waveguide-excited terahertz microstrip antenna. The waveguide-excited terahertz microstrip antenna can be applied to an application environment as shown in FIG. 1. In this application environment, a terahertz wave is emitted from a terahertz source 10 and radiated out via a waveguide-excited terahertz microstrip antenna 20. The terahertz source 10 is not limited herein and can be any terahertz source based on a frequency multiplier, a frequency mixer, or a terahertz quantum cascade laser (THz QCL).

Figure 2:
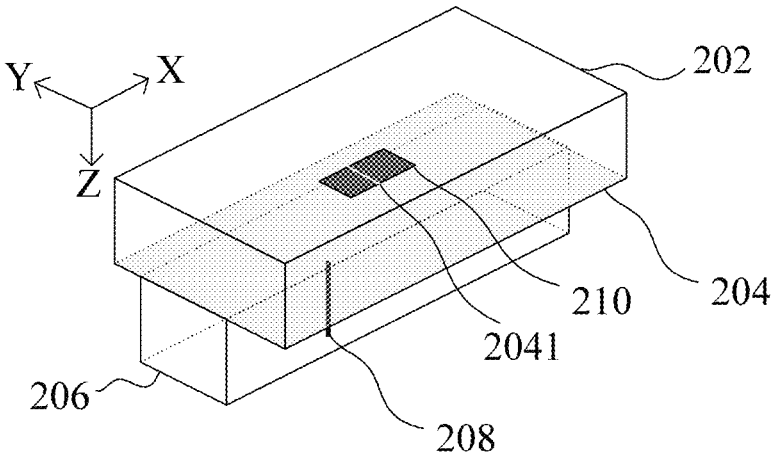
FIG. 2 is a schematic structural view of the waveguide-excited terahertz microstrip antenna according to an embodiment of the present disclosure.
Figure 3:
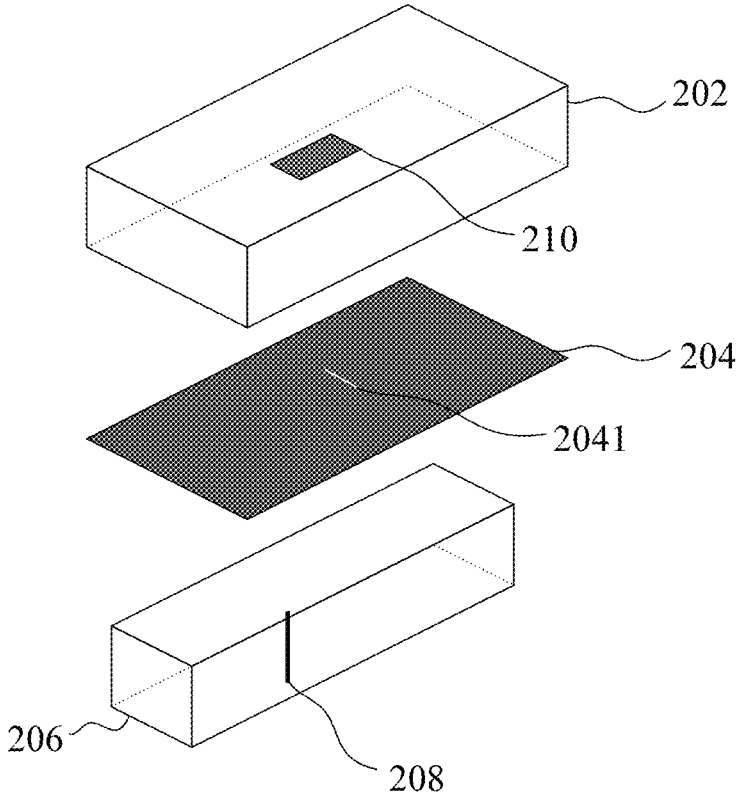
FIG. 3 is a partially exploded view of the waveguide-excited terahertz microstrip antenna according to an embodiment of the present disclosure.

Referring to FIG. 2 and FIG. 3, a waveguide-excited terahertz microstrip antenna 20 provided in an embodiment of the present disclosure includes a dielectric substrate 202, a ground plate 204, a rectangular waveguide 206, a metal pin 208, and a radiation patch 210.

The dielectric substrate 202 has a first surface and a second surface opposite to the first surface. The ground plate 204 is located on the first surface of the dielectric substrate 202 and defines a coupling slit 2041. The rectangular waveguide 206 is located on a surface of the ground plate 204 away from the dielectric substrate 202, and the rectangular waveguide 206 is extended substantially along a first direction X. The metal pin 208 is located inside the rectangular waveguide 206 and is in contact with the ground plate 204 and substantially perpendicular to the ground plate 204. The radiation patch 210 is located on the second surface of the dielectric substrate 202.

The dielectric substrate 202 is configured to support components such as the ground plate 204, the rectangular waveguide 206, the metal pin 208, and the radiation patch 210. Each of the ground plate 204, the rectangular waveguide 206, the metal pin 208, and the radiation patch 210 can be disposed on the first surface or the second surface of the dielectric substrate 202. In an embodiment, the ground plate 204, the rectangular waveguide 206, and the metal pin 208 are disposed on the first surface, and the radiation patch 210 are disposed on the second surface.

A shape and a dimension of the dielectric substrate 202 are not limited herein and can be decided according to a center working frequency $f_0$ of the terahertz microstrip antenna 20. In an embodiment, the dielectric substrate 202 can be a cubical substrate and is dimensioned to be able to support the components such as the ground plate 204, the rectangular waveguide 206, the metal pin 208, and the radiation patch 210. The first direction can be a length direction of the dielectric substrate 202. The first surface and the second surface can be opposite to each other in a thickness direction of the dielectric substrate 202.

The ground plate 204 can be disposed on the first surface of the dielectric substrate 202. The ground plate 204 can be attached on the entire first surface of the dielectric substrate 202. The ground plate 204 can be made of a conductive material, such as gold, silver, copper, aluminum, and so on. The ground plate 204 can have a thickness larger than a skin depth of the terahertz microstrip antenna 20 at the center working frequency $f_0$.

The ground plate 204 can define the coupling slit 2041. The coupling slit 2041 can be a through-slot extending through the ground plate 204 substantially along a third direction Z perpendicular to the first surface or the second surface of the dielectric substrate 202 and lengthening substantially along a second direction Y perpendicular to the first direction X and the third direction Z. The coupling slit 2041 can be located and dimensioned to minimize a return loss of the terahertz microstrip antenna 20 at the center working frequency $f_0$.

In an embodiment, a length La of the coupling slit 2041 is about 30% to about 80% of a center working wavelength of the terahertz microstrip antenna 20, and a width Wa of the coupling slit 2041 is about 1% to about 6% of the center working wavelength of the terahertz microstrip antenna 20.

The length La and the width Wa of the coupling slit 2041 can be chosen to make a working wavelength of the coupling slit 2041 in consistent with the center working wavelength of the terahertz microstrip antenna 20. When to decide the dimension of the coupling slit 2041, an initial length La and an initial width Wa of the coupling slit 2041 can be set firstly. For example, the initial length La of the coupling slit 2041 can be set as 60% of the center working wavelength of the terahertz microstrip antenna 20, and the initial width Wa of the coupling slit 2041 can be set as 4% of the center working wavelength of the terahertz microstrip antenna 20. Then a parameter scan can be performed to decide the parameters of the terahertz microstrip antenna 20 without the metal pin 208 through an electromagnetic simulation software (for example, a high frequency structure simulator) by using values adjacent to the initial length La and the initial width Wa of the coupling slit 2041. Thereafter, an optimal length La and an optimal width Wa of the coupling slit 2041, which make the working wavelength of the coupling slit 2041 in consistent with the center working wavelength of the terahertz microstrip antenna, can be selected from the values adjacent to the initial length La and the initial width Wa of the coupling slit 2041.

Figure 4:
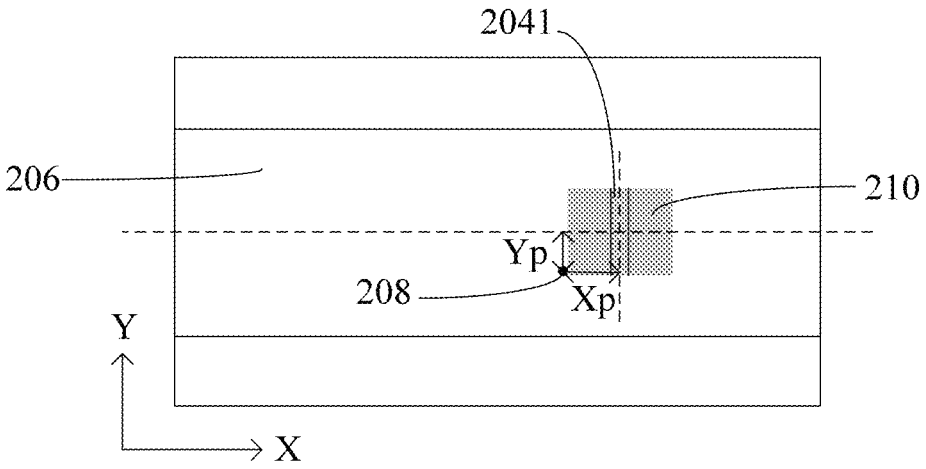
FIG. 4 is a plane view showing a location of a metal pin of the waveguide-excited terahertz microstrip antenna according to an embodiment of the present disclosure.

Referring to FIG. 4, a center line of the coupling slit 2041 substantially along the first direction X can be coincident with a center line of the rectangular waveguide 206 substantially along the first direction X. A distance between the coupling slit 2041 and each of two ends of the rectangular waveguide 206 in the first direction X can be larger than 5 times of the center working wavelength of the terahertz microstrip antenna 20 to prevent the coupling of the coupling slit 2041 with the two ends of the rectangular waveguide 206.

In an embodiment, the central working frequency $f_0$ of the terahertz microstrip antenna 20 is 1.86 THz, the optimal length La of the coupling slit 2041 can be about 89 μm, and the optimal width Wa of the coupling slit 2041 can be about 6.6 μm.

The rectangular waveguide 206 can be disposed on the surface of the ground plate 204 away from the dielectric substrate 202 and extend substantially along the first direction X.

The first direction X can be the length direction of the dielectric substrate 202. The first direction X can be substantially parallel to the first surface and/or the second surface of the dielectric substrate 202. The rectangular waveguide 206 can be attached on the surface of the ground plate 204 away from the dielectric substrate 202. As such, the ground plate 204 can be sandwiched between the rectangular waveguide 206 and the dielectric substrate 202.

The rectangular waveguide 206 can have a longitudinal cross-section substantially parallel to the first surface of the dielectric substrate 202. A type of the rectangular waveguide 206 can be selected based upon the center working frequency $f_0$ of the terahertz microstrip antenna 20. For example, the rectangular waveguide 206 can be selected as a type of waveguide able to transmit a pre-determined working frequency band from a standard waveguide catalog according to the center working frequency $f_0$ of the terahertz microstrip antenna 20. Parameters of the rectangular waveguide 206 can be determined based upon the center working frequency $f_0$ of the terahertz microstrip antenna 20.

In an embodiment, the rectangular waveguide 206 can have a length of about 130 μm and a width of about 65 μm. The length of the rectangular waveguide 206 in the first direction X can be substantially the same as a length of the dielectric substrate 202 in the first direction X. The rectangular waveguide 206 can be made of a material such as copper and aluminum.

The metal pin 208 extends through the rectangular waveguide 206 and is substantially perpendicular to the first surface of the dielectric substrate 202. The metal pin 208 can be located at a side of the ground plate 204 away from the first surface of the dielectric substrate 202. A location and a diameter of the metal pin 208 can be determined according to the specific center working frequency $f_0$ of the terahertz microstrip antenna 20. The location and the diameter of the metal pin 208 can affect the return loss of the terahertz microstrip antenna 20 at the center working frequency $f_0$. The location and the diameter of the metal pin 208 can be set to minimize the return loss of the terahertz microstrip antenna 20 at the center working frequency $f_0$. In an embodiment, a distance Yp between an axis of the metal pin 208 substantially along the third direction Z and the center line of the rectangular waveguide 206 substantially along the first direction X can be about 10% to 30% of the center working wavelength of the terahertz microstrip antenna 20. A distance Xp between the axis of the metal pin 208 substantially along the third direction Z and a center line of the coupling slit 2041 substantially along the second direction Y can be about 10% to about 40% of the center working wavelength of the terahertz microstrip antenna 20.

The diameter of the metal pin 208 can be about 2% to about 6% of the center working wavelength of the terahertz microstrip antenna 20.

To determine the diameter of the metal pin 208, an initial diameter of the metal pin 208 can be set firstly. For example, the initial diameter of the metal pin 208 can be set as about 4% of the center working wavelength of the terahertz microstrip antenna 20. Then a parameter scan can be performed for the terahertz microstrip antenna 20 with the metal pin 208 through an electromagnetic simulation software (for example, a high frequency structure simulator) by using values adjacent to the initial diameter of the metal pin 208. Thereafter, an optimal diameter of the metal pin 208, which minimizes the return loss of the terahertz microstrip antenna 20 at the center working frequency, can be selected from the values adjacent to the initial diameter of the metal pin 208. The diameter of the metal pin 208 selected by this method allows a maximum reduction in the return loss of the terahertz microstrip antenna 20 at the center working frequency $f_0$.

To determine the location of the metal pin 208, an initial distance Yp and an initial distance Xp can be set firstly. For example, the initial distance Yp can be set as 19% of the center working wavelength of the terahertz microstrip antenna 20, and the initial distance Xp can be set as 24% of the center working wavelength of the terahertz microstrip antenna 20. Then a parameter scan can be performed for the terahertz microstrip antenna 20 with the metal pin 208 disposed through an electromagnetic simulation software (for example, a high frequency structure simulator) by using values adjacent to the initial distance Yp and the initial distance Xp. Thereafter, an optimal distance Yp and an optimal distance Xp, which minimizes the return loss of the terahertz microstrip antenna 20 at the center working frequency $f_0$, can be selected from the values adjacent to the initial distance Yp and the initial distance Xp, so as to determine the optimal location of the metal pin 208. The location of the metal pin 208 selected by this method allows a maximum reduction in the return loss of the terahertz microstrip antenna 20 at the center working frequency.

In an embodiment, the diameter of the metal pin 208 is about 3 μm. The distance Yp is about 38 μm. The distance Xp is about 30 μm. A material of the metal pin 208 can be at least one of gold, silver, copper, aluminum, and so on.

The radiation patch 210 is disposed on the second surface of the dielectric substrate 202 and is spaced from the ground plate 204, the rectangular waveguide 206, and the metal pin 208 by the dielectric substrate 202. The radiation patch 210 can be attached on the second surface of the dielectric substrate 202. The radiation patch 210 can have a rectangular shape with the first direction X as its length direction and with the second direction Y as its width direction. The radiation patch 210 can have a center line substantially along the second direction Y coincided with the center line of the coupling slit 2041 substantially along the second direction Y.

A width Wp and a length Lp of the radiation patch 210 can be calculated according to empirical equations of the terahertz microstrip antenna 20. The width Wp of the radiation patch 210 is associated with a light speed c, the central working frequency $f_0$ of the terahertz microstrip antenna 20, and a relative permittivity $\varepsilon_r$ of the dielectric substrate 202. The length Lp of the radiation patch 210 is associated with the light speed c, the central working frequency $f_0$ of the terahertz microstrip antenna 20, an effective relative permittivity $\varepsilon_{re}$ of the dielectric substrate 202, and an increase ΔL in an effective length compared with from the length Lp of the radiation patch 210 caused by a fringing field of the terahertz microstrip antenna 20.

The width Wp of the radiation patch 210 can be calculated according to the following equation I:

$$W_p = \frac{c}{2f_0}\left(\frac{\varepsilon_r + 1}{2}\right)^{-\frac{1}{2}}. \quad \text{I}$$

The length Lp of the radiation patch 210 can be calculated according to the following equation II:

$$L_p = \frac{c}{2f_0}\frac{1}{\varepsilon_{re}} - 2\Delta L. \quad \text{II}$$

The increase ΔL in the effective length caused by a fringing field of the terahertz microstrip antenna 20 can be calculated according to the following equation III:

$$\Delta L = 0.412h\frac{(\varepsilon_{re} + 0.3)(W_p/h + 0.264)}{(\varepsilon_{re} - 0.258)(W_p/h + 0.8)},$$

wherein h represents a thickness of the dielectric substrate 202.

The terahertz microstrip antenna 20 can be designed according to the above empirical equations, actual needs, and desired structure of the terahertz microstrip antenna 20. In an embodiment, the width Wp of the radiation patch 210 is about 85 μm and the length Lp of the radiation patch 210 is about 89 μm. The radiation patch 210 can be made of a metal material, such as gold, silver, copper, and aluminum.

In the terahertz microstrip antenna 20, a terahertz wave is input into one end of the waveguide 206 in the first direction X from a terahertz source and transmitted to the coupling slit 2041 via the waveguide 206. A terahertz wave consistent with a resonant frequency of the coupling slit 2041 can be coupled into a resonant cavity formed between the radiation patch 210 and the ground plate 204 via the coupling slit 2041, and then radiated out via narrow gaps formed by edges of the radiation patch 210 and the ground plate 204. As such, the function of radiating terahertz wave can be achieved by the terahertz microstrip antenna 20.

In the present disclosure, the coupling slit 2041 and the impedance matching metal pin 208 increase the coupling efficiency of the waveguide 206 with the radiation patch 210. The input impedance of the terahertz microstrip antenna 20 is adjustable by providing the coupling slit 2041 and the impedance matching metal pin 208. As such, the terahertz microstrip antenna 20 of present disclosure can have a low return loss, a narrow bandwidth, and a low gain within the terahertz waveband.

In an embodiment, the central working frequency $f_0$ of the terahertz microstrip antenna 20 is 1.86 THz. The dimension parameters of the terahertz microstrip antenna 20 are list in Table 1

| Parameter | Size (μm) | Parameter | Size (μm) |
|---|---|---|---|
| $L_w$ | 130 | $y_p$ | 38 |
| $W_w$ | 65 | $X_p$ | 30 |
| $L_p$ | 53 | R | 3 |
| $W_p$ | 85 | $L_d$ | 650 |
| $L_a$ | 89 | $W_d$ | 320 |
| $W_a$ | 6.6 | $H_d$ | 16 |

$L_w$ and $W_w$ represent a length and a width of the rectangular waveguide 206, respectively. $L_p$ and $W_p$ represent a length and a width of the rectangular radiation patch 210, respectively. $L_a$ and $W_a$ represent a length and a width of the rectangular coupling slit 2041, respectively. R represents a radius of the metal pin 208. $L_d$, $W_d$, and $H_d$ represent a length, a width, and a thickness of the dielectric substrate 202. Yp represents a distance between the axis of the metal pin 208 substantially along the third direction Z and the center line of the rectangular waveguide 206 substantially along the first direction X. Xp represents a distance between the axis of the metal pin 208 substantially along the third direction Z and the center line of the coupling slit 2041 substantially along the second direction Y.

Figure 5:
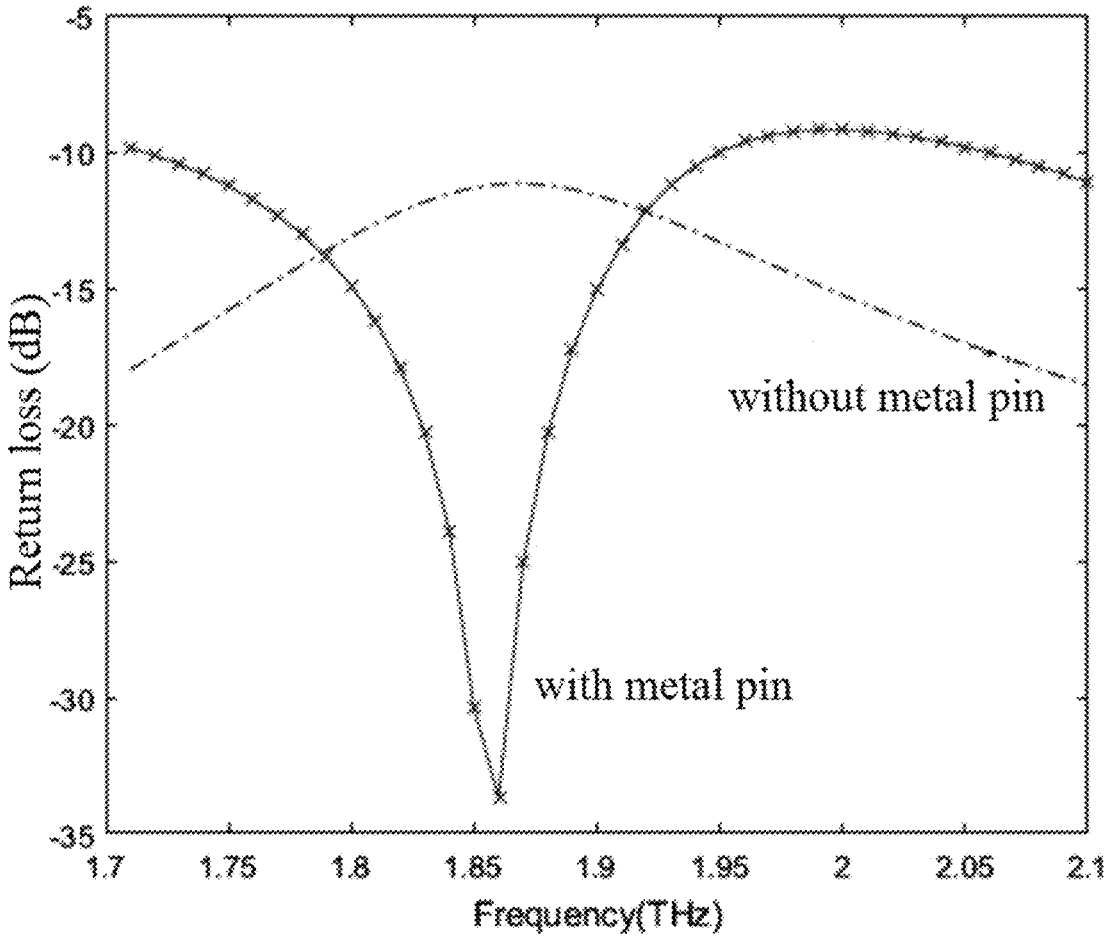
FIG. 5 is a comparison diagram of return loss curves of terahertz microstrip antennas with and without a metal pin according to embodiments of the present disclosure.

FIG. 5 is a comparison diagram of return loss curves of terahertz microstrip antennas with and without the metal pin disposed. It can be seen that the return loss curve of the terahertz microstrip antenna without the metal pin disposed has a maximum at the central working frequency, which is resulted from the frequency resonance of the terahertz microstrip antenna at the working frequency. However, the return loss curve of the terahertz microstrip antenna with the metal pin has a minimum at the central working frequency, demonstrating that the input impedance of the terahertz microstrip antenna can be changed by the metal pin. Therefore, in the present disclosure, the input impedance of the terahertz microstrip antenna can be adjusted by regulating the diameter and the location of the metal pin, so as to adjust the return loss of the terahertz microstrip antenna.

Figure 6:
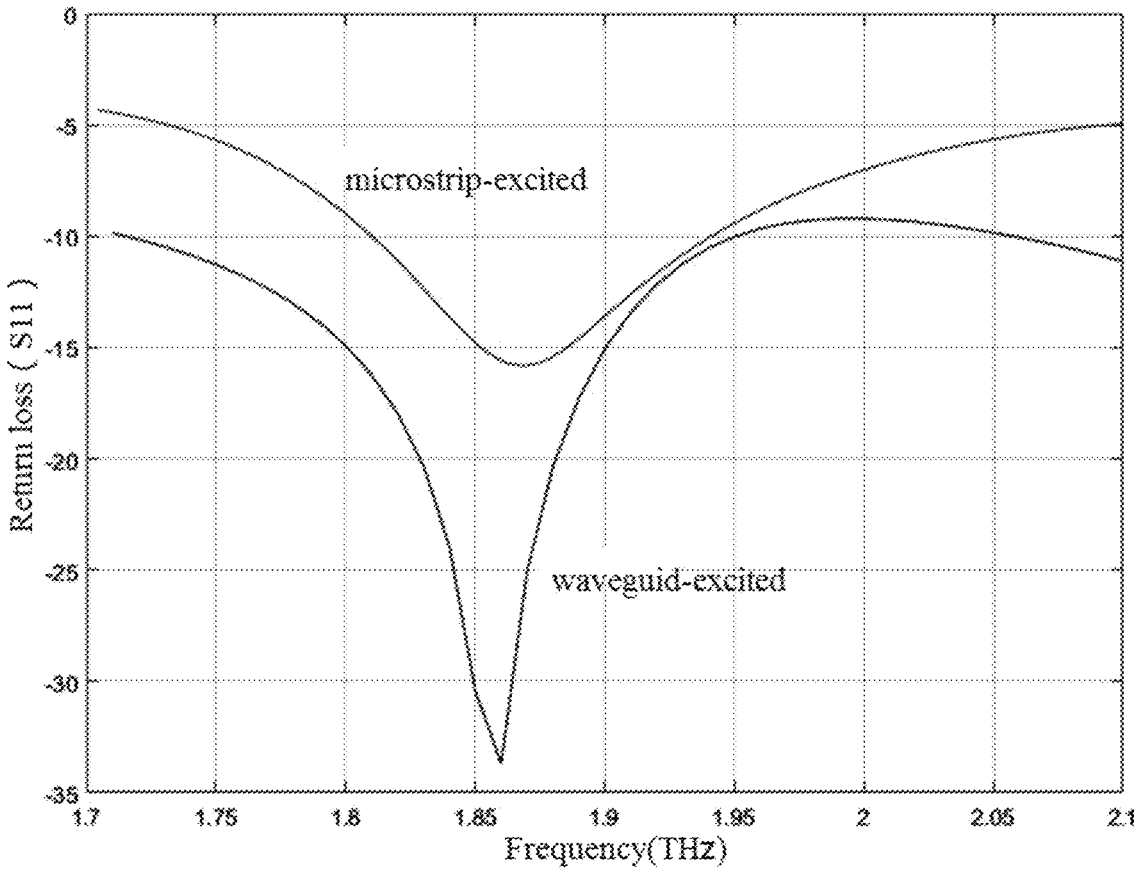
FIG. 6 is a comparison diagram of return loss curves of the terahertz microstrip antenna according to an embodiment of the present disclosure and a conventional microstrip-excited terahertz microstrip antenna.

FIG. 6 is a comparison diagram of return loss curves of the terahertz microstrip antenna of the present disclosure and the conventional microstrip-excited terahertz microstrip antenna. It can be seen that the terahertz microstrip antenna of the present disclosure has a lower return loss and a wider working bandwidth than the conventional microstrip-excited terahertz microstrip antenna.

Figure 7:
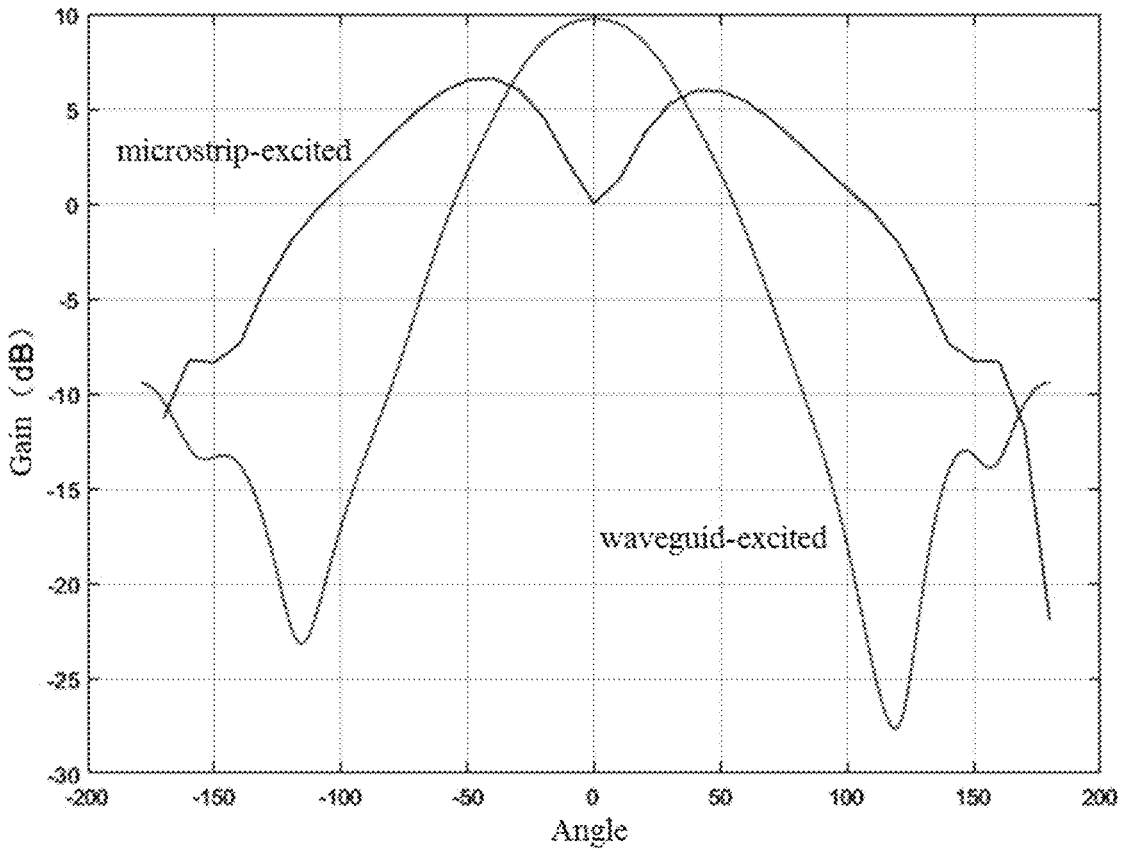
FIG. 7 is a comparison diagram of curves of gains in E planes of the terahertz microstrip antenna according to an embodiment of the present disclosure and the conventional microstrip-excited terahertz microstrip antenna.

FIG. 7 is a comparison diagram of curves of gains in E planes of the terahertz microstrip antenna of the present disclosure and the conventional microstrip-excited terahertz microstrip antenna. It can be seen that the terahertz microstrip antenna of the present disclosure has a greater gain at the center working frequency than the conventional microstrip-excited terahertz microstrip antenna.

The designs of locations and dimensions of the metal pin 208, the radiation patch 210, and the coupling slit 2401 of the present disclosure allow to decrease the return loss of the terahertz microstrip antenna 20 at the central working frequency, increase the working bandwidth of the terahertz microstrip antenna 20 at the central working frequency, and enhance the gain of the terahertz microstrip antenna 20 at the central working frequency, comparing with the conventional microstrip-excited terahertz microstrip antenna.

The technical features of the above-described embodiments may be arbitrarily combined. In order to make the description simple, not all possible combinations of the technical features in the above embodiments are described. However, as long as there is no contradiction in the combination of these technical features, the combinations should be in the scope of the present application.

What described above are only several implementations of the present application, and these embodiments are specific and detailed, but not intended to limit the scope of the present application. It should be understood by the skilled in the art that various modifications and improvements can be made without departing from the conception of the present application, and all fall within the protection scope of the present application. Therefore, the patent protection scope of the present application is defined by the appended claims

What is claimed is:

1. A waveguide-excited terahertz microstrip antenna, comprising:

a dielectric substrate having a first surface and a second surface opposite to the first surface;

a ground plate located on the first surface of the dielectric substrate and defining a coupling slit;

a rectangular waveguide located on a surface of the ground plate away from the dielectric substrate and extending substantially along a first direction parallel to the first surface;

a metal pin located inside the rectangular waveguide, being in contact with the ground plate and substantially perpendicular to the ground plate; and a radiation patch located on the second surface of the dielectric substrate.

2. The terahertz microstrip antenna of claim 1, wherein the rectangular waveguide is attached on the surface of the ground plate away from the dielectric substrate, and the ground plate is sandwiched between the rectangular waveguide and the dielectric substrate.

3. The terahertz microstrip antenna of claim 1, wherein the radiation patch is attached on the second surface.

4. The terahertz microstrip antenna of claim 1, wherein the radiation patch has a rectangular shape with the first direction as its length direction and with a second direction substantially perpendicular to the first direction and substantially parallel to the first surface of the dielectric substrate as its width direction.

5. The terahertz microstrip antenna of claim 1, wherein a width of the radiation patch satisfies the following equation I:

$$W_p = \frac{c}{2f_0}\left(\frac{\varepsilon_r + 1}{2}\right)^{-\frac{1}{2}}; \quad \text{I}$$

and a length of the radiation patch satisfies the following equation II:

$$L_p = \frac{c}{2f_0}\frac{1}{\varepsilon_{re}} - 2\Delta L; \quad \text{II}$$

wherein c represents a light speed, $f_0$ represents a central working frequency of terahertz microstrip antenna, $\varepsilon_r$ represents a relative permittivity of the dielectric substrate, $\varepsilon_{re}$ represents an effective relative permittivity of the dielectric substrate, and $\Delta L$ represents an increase in effective length caused by a fringing field of the terahertz microstrip antenna.

6. The terahertz microstrip antenna of claim 1, wherein the coupling slit is a through-slot extending through the ground plate substantially along a third direction perpendicular to the first surface of the dielectric substrate and having a length substantially along a second direction perpendicular to the first direction and the third direction.

7. The terahertz microstrip antenna of claim 6, wherein the length of the coupling slit is about 30% to about 80% of a center working wavelength of the terahertz microstrip antenna, and a width of the coupling slit is about 1% to about 6% of the center working wavelength of the terahertz microstrip antenna.

8. The terahertz microstrip antenna of claim 6, wherein the coupling slit is dimensioned to have a working wavelength of the coupling slit consistent with a center working wavelength of the terahertz microstrip antenna.

9. The terahertz microstrip antenna of claim 6, wherein the radiation patch has a center line substantially along the first direction coinciding with a center line of the coupling slit substantially along the first direction.

10. The terahertz micro strip antenna of claim 1, wherein the metal pin extends through the rectangular waveguide substantially along a third direction perpendicular to the first surface of the dielectric substrate.

11. The terahertz microstrip antenna of claim 10, wherein a location and/or a diameter of the metal pin is capable of minimizing a return loss of the terahertz microstrip antenna at a center working frequency of the terahertz microstrip antenna.

12. The terahertz microstrip antenna of claim 10, wherein the diameter of the metal pin is about 2% to about 6% of a center working wavelength of the terahertz microstrip antenna.

13. The terahertz microstrip antenna of claim 10, wherein a distance between an axis of the metal pin substantially along the third direction and a center line of the rectangular waveguide substantially along the first direction is about 10% to 30% of a center working wavelength of the terahertz microstrip antenna, and a distance between the axis of the metal pin substantially along the third direction and a center line of the coupling slit substantially along a second direction perpendicular to the first direction and the third direction is about 10% to about 40% of the center working wavelength of the terahertz microstrip antenna.

14. The waveguide-excited terahertz microstrip antenna of claim 1, wherein the ground plate has a thickness larger than a skin depth of the terahertz microstrip antenna at a center working frequency of the terahertz microstrip antenna.

15. The waveguide-excited terahertz microstrip antenna of claim 1, wherein a length of the rectangular waveguide in the first direction is substantially the same as a length of the dielectric substrate in the first direction.

16. The waveguide-excited terahertz microstrip antenna of claim 1, wherein a center line of the coupling slit substantially along the first direction coincides with a center line of the rectangular waveguide substantially along the first direction.

17. The waveguide-excited terahertz microstrip antenna of claim 1, wherein a distance between the coupling slit and each of two ends of the rectangular waveguide in the first direction is larger than 5 times of a center working wavelength of the terahertz microstrip antenna.

* * * * *